US006860217B1

(12) United States Patent
Beechie

(10) Patent No.: US 6,860,217 B1
(45) Date of Patent: Mar. 1, 2005

(54) METHOD FOR MUFFLING DISCHARGE WATER FROM MARINE VESSELS

(76) Inventor: Brian Edward Beechie, 76801 Omo Rd., Armada, MI (US) 48005

( * ) Notice: Subject to any disclaimer, the term of this patent is extended or adjusted under 35 U.S.C. 154(b) by 112 days.

(21) Appl. No.: 10/249,120

(22) Filed: Mar. 17, 2003

(51) Int. Cl.[7] ..... B63B 13/00
(52) U.S. Cl. ..... 114/183 R
(58) Field of Search ..... 114/173, 179, 114/182, 183 R, 184

(56) References Cited

U.S. PATENT DOCUMENTS 2,713,841 A * 7/1955 Forbes ..... 440/89 R
3,351,036 A * 11/1967 Paoli ..... 114/183 R
3,394,671 A * 7/1968 Mayer ..... 114/183 R
3,550,548 A * 12/1970 De Persia ..... 114/183 A

* cited by examiner

*Primary Examiner*—Stephen Avila

(57) ABSTRACT

An apparatus for muffling the discharge of water from the hulls of marine vessels. The apparatus generally includes a base component with a bottom and a top, a method of attaching the device to the hull of a marine vessel, and a discharge carrier generally in the form of a tube used to control the discharge of water into the main body of water. The device will allow the discharge of water from the vessel to be introduced to the main body of water at or below the main body of water's surface at a reduced velocity and over a larger surface area, greatly reducing the amount of noise generally associated with water being discharged from said vessels.

6 Claims, 2 Drawing Sheets

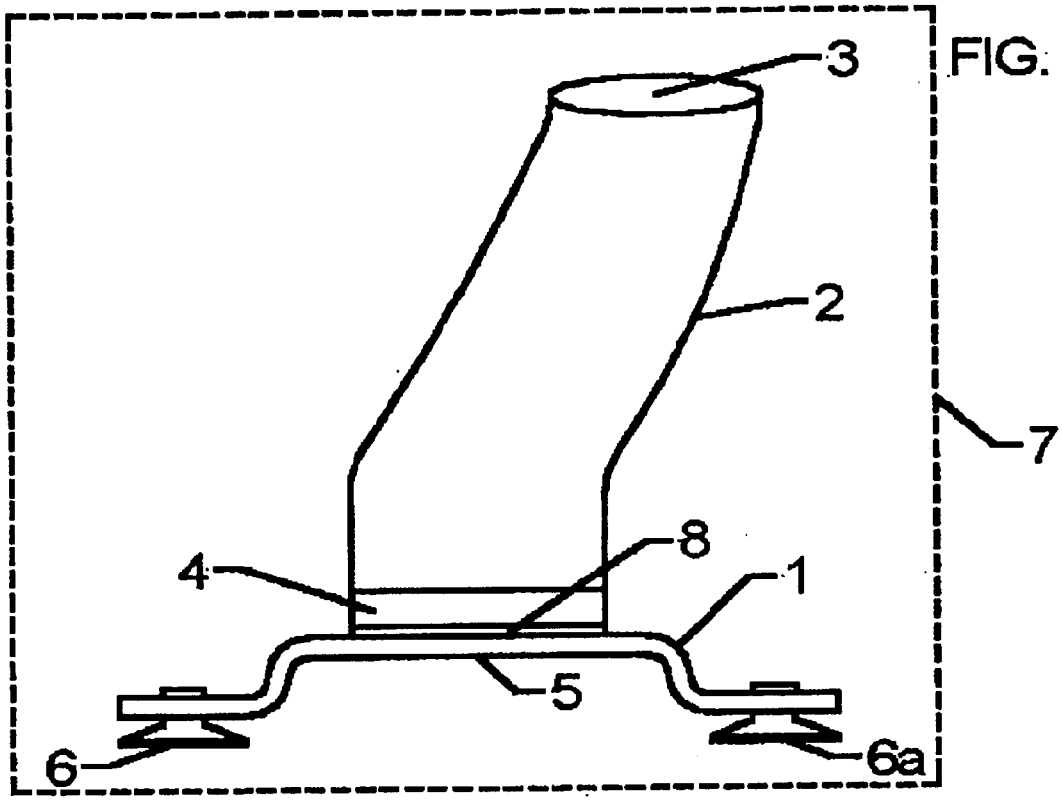
FIG. 1
FIG. 2
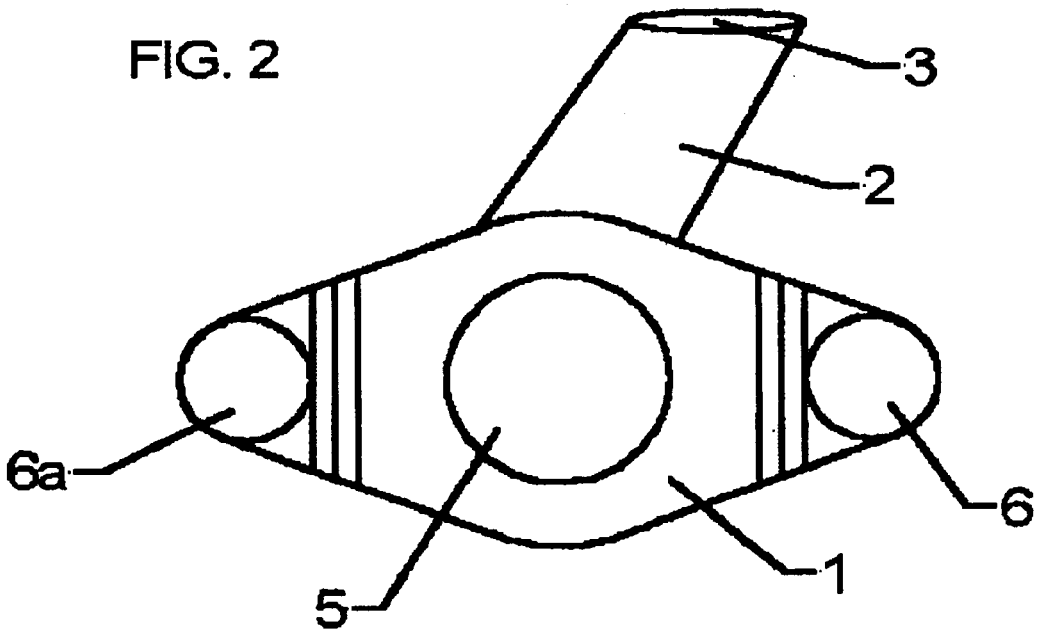

METHOD FOR MUFFLING DISCHARGE WATER FROM MARINE VESSELS

BACKGROUND OF INVENTION

In marine vessels it is known that various systems such as air conditioning, bilge pumps, and water drains, discharge water overboard directly into the body of water in which the vessel is present in.

This discharge of water makes an audible sound when the discharge water contacts the main body of water in which the vessel is present in. This discharge water is typically introduced to the primary body of water in a free stream form, exiting the side or hull of the vessel falling to the surface of the surrounding water. In these cases it is desirable to reintroduce the discharge water at a controlled rate at or below the surface of the surrounding water, allowing the discharge noise to be substantially reduced.

SUMMARY OF INVENTION

In one form, the present invention provides an apparatus for reducing the noise level of fluids being discharged from marine vessels as the fluids come in contact with the surrounding water that the vessel presides in while the vessel is at rest. The apparatus includes a base unit which has two ends. The first end, the bottom, attaches itself to the hull of the marine vessel in question over a port in the hull which is used for discharge of water. The second end, the top, has an outlet to which the third part, the discharge carrier, which has a flexible generally tubular cross section, attaches itself to the top. The discharge carrier, or third part, is attached to the top to allow the egress of the discharge water into the body of water that the vessel is residing in. This method of guiding the discharge water through the discharge carrier causes the water or other fluids to reduce in velocity and increase in surface area while in side the flexible generally tubular cross section discharge tube, instead of the conventional method of the discharge water being allowed to freefall into the primary body of water, resulting in a muffling of the noise usually associated with the aforementioned freefall of water as it is introduced into the surrounding water that the vessel presides in while the vessel is at rest.

Further areas of applicability of the present invention will become apparent from the detailed description provided hereinafter, it should be understood that the detailed description and specific examples, while indicating the preferred embodiment of the invention, are intended for purpose of illustration only and are not intended to limit the scope of the invention.

BRIEF DESCRIPTION OF DRAWINGS

The present invention will become more fully understood from the detailed description and the accompanying drawings, wherein:

FIG. 1 is a side view of the discharge muffling device.

FIG. 2 is a bottom view of the discharge muffling device.

DETAILED DESCRIPTION

Figure 3:
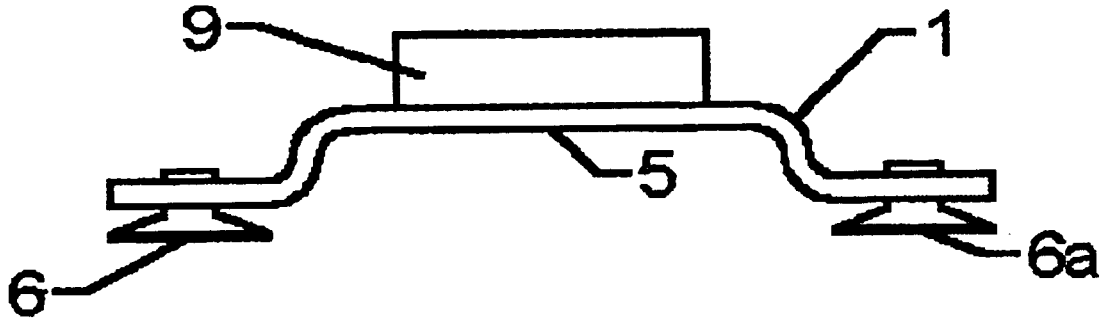
FIG. 3 is a side view of the discharge muffling device from FIG. 1 with the discharge carrier removed.

The following description of the preferred embodiment(s) is merely exemplary in nature and is in no way intended to limit the invention, it's application, or uses.

With reference to FIG. 1 a side view of the discharge muffling device assembly 7 is shown in accordance a first embodiment of the present invention. The discharge muffling device assembly 7 is shown to include a base component 1 which is attached to the hull of the vessel over the vessels water discharge port by suction devices 6 and 6*a*. In operation, water is discharged from the vessel into a hole 5 in the base 1 and is guided to the surface of the body of water through the discharge carrier body portion 2 exiting opening 3. When the discharge water passes through the discharge carrier body 9 the discharged water will strike the interior surface of the flexible tubular cross section discharge tube 2. This allows the discharge water to reduce in velocity and increase in surface area while in side the flexible generally tubular cross section discharge tube. When the discharge water exits from opening 3 in this modified condition the discharged water will be audibly muffled as it is introduced to the body of water in which the vessel is presiding.

As shown in FIGS. 1–3 the device generally includes a main body base component 1 with a hole in the base 5 to allow water which is discharged from a marine vessel to pass through the base 1. On the top of base 1 a raised ring 9 is used to allow connection to the tubular main body portion 2.

The discharge carrier body portion 2 is used to allow communication of fluid between the base 1 and discharge opening 3. Discharge carrier body portion 2 has a general linear form and has a first end 8 which attaches to main body base 1 around raised ring 9. Water that is discharged from the vessel travels through tubular main body portion 2 and exits out opening 3 extending therethrough. It is readily appreciated that the tubular main body portion 2 may be formed in a variety of shapes including flexible bends and angles to allow end opening 3 to be in contact with the principle body of water in which the vessel is presiding.

Discharge carrier body portion 2 is attached by first end 8 to the main body base 1 at component raised ring 9 by fastening ring 4. However, it is contemplated that other attachment methods such as staples, common screws, hook and loop fasteners, etc. may be used to form the attachment between first end 8 and raised ring 9.

The discharge muffling device, assembly 7, is shown to include the description of the invention and is merely exemplary in nature and, thus, variations that do not depart from the gist of the invention are intended to be within the scope of the invention. Such variations are not to be regarded as a departure from the spirit and scope of the invention.

What is claimed is:

1. An apparatus that is temporarily affixed to a marine vessel that is used for muffling the audible sound of water being discharged from said vessel while at rest which has a permanent outlet from which water is discharged from said vessel into the body of water which the vessel resides, a base portion of the device consisting of a bottom and a top surface, the bottom with a method of temporarily attaching the device to the hull of the marine vessel over previously described hull outlet, with an opening which guides the discharge water into the device, and the top surface flange to which a discharge carrier connects, a flexible discharge carrier whose main purpose is to increase the surface area and reduce the velocity of the discharge water consisting of two ends, the first end which attaches to the base, and the second end that allows water to flow out at or below the surface of the surrounding body of water while the vessel is at rest.

2. The apparatus of claim 1 wherein the base portion of the device can be temporarily affixed to the hull of the vessel while the vessel is at rest and is affixed over a permanent outlet in the hull of the vessel which is generally used for the discharge of water.

3. The apparatus of claim 1 wherein said base unit that has been temporarily affixed to the hull of the vessel has an inlet opening which allows the vessels discharge water to enter the apparatus guiding the discharge water into and through the base.

4. The apparatus of claim 1 wherein the base unit has a hole through itself which guides the discharge water out of the base unit and into the flexible generally tubular cross section discharge tube.

5. The apparatus of claim 1 wherein the flexible generally tubular cross section discharge tube causes the vessels discharge water to reduce in velocity and increase in surface area while in side the flexible generally tubular cross section discharge tube, introducing the discharged water at a much reduced velocity and over a greater surface area significantly reducing the audible impact noise of the discharged water as it is introduced to the body of water in which the vessel presides.

6. The apparatus of claim 1 wherein said discharge carrier is of a flexible generally tubular cross section and is allowed to flex and bend as to connect from the attachment base at the discharge port to terminate at or below the surface of the water in which the vessel is presiding in.

* * * * *